US006002116A

United States Patent [19]

St. Louis

[11] Patent Number: 6,002,116

[45] Date of Patent: Dec. 14, 1999

[54] HEATER COIL MOUNTING ARRANGEMENT

[75] Inventor: Robert Maurice St. Louis, St. Leonard, Canada

[73] Assignee: Camco Inc., Mississauga, Canada

[21] Appl. No.: 09/305,307

[22] Filed: May 5, 1999

[51] Int. Cl.[6] ..... H05B 3/06

[52] U.S. Cl. ..... 219/542; 219/357; 219/465.1; 219/478; 219/532; 219/536; 219/537; 33/133; 174/138 J; 174/158

[58] Field of Search ..... 219/532, 542, 219/465.1, 478, 357, 536, 460.1, 461.1; 33/133; 174/158, 138 J, 167

[56] References Cited

U.S. PATENT DOCUMENTS

| | | | |
|---|---|---|---|
| 3,560,708 | 2/1971 | Fox | 219/357 |
| 4,472,624 | 9/1984 | Janning | 219/532 |
| 4,628,189 | 12/1986 | Danko | 219/532 |
| 4,656,340 | 4/1987 | St. Louis | 219/532 |
| 4,700,495 | 10/1987 | Drews | 33/133 |
| 4,994,654 | 2/1991 | St. Louis | 219/532 |
| 5,093,558 | 3/1992 | Blystone et al. | 219/532 |
| 5,134,270 | 7/1992 | Bragg et al. | 219/532 |
| 5,329,098 | 7/1994 | Howard | 219/532 |
| 5,925,273 | 7/1999 | Sherrill | 219/478 |
| 5,935,471 | 8/1999 | St. Louis | 219/465.1 |

FOREIGN PATENT DOCUMENTS

| | | |
|---|---|---|
| 771787 | 11/1967 | Canada . |
| 889457 | 12/1971 | Canada . |

*Primary Examiner*—John A. Jeffery
*Assistant Examiner*—L. Fastovsky

[57] ABSTRACT

There is disclosed an arrangement for mounting a heating coil relative to a supporting wall of a clothes dryer heater housing. An insulator has a main body portion adapted to secure the heating coil relative thereto and a base portion adapted to be seated in fixed relation to the supporting wall. The base portion has first and second flanges which curve downwardly and outwardly from the insulator. The support wall has two raised tab members which are adapted to define between these tab members and the supporting wall a recessed channel for receiving the first flange of the insulator. The supporting wall further has two spaced apart guide members for engagement with opposite sides of the second flange of the base member to prevent relative lateral movement of the insulator. The supporting wall has a pivotably movable locking flange which is pivotable about a crease located between the two guide members. The locking flange has a hook adapted to move into engagement with the second flange of the insulator to prevent the insulator from being pulled away from the supporting wall surface.

8 Claims, 3 Drawing Sheets

HEATER COIL MOUNTING ARRANGEMENT

FIELD OF THE INVENTION

This invention relates to a heater coil mounting arrangement for mounting a heater coil and insulator bracket to a supporting wall of a clothes dryer heater housing.

BACKGROUND OF THE INVENTION

Typical heating coil mounting arrangements include a helical heating coil through which electrical energy passes to generate heat. The heating coils are typically mounted by a bracket with an insulator to a support wall. In some instances, the bracket is a one-piece ceramic to insulator which has the heater bracket mounted directly to the supporting wall.

One such heating bracket arrangement is shown in my U.S. patent application Ser. No. 09/052,121 filed Mar. 31, 1998 and entitled Heater Coil Support in Mounting Bracket. In this arrangement, the bracket is slid into a supporting wall having upper and lower surfaces and an elongated slot passing through this wall. The slot has an intermediate widened portion and a first narrow end extending away from the first end of the widened portion. The narrowed end extends away from the second end of the widened portion opposite to the first end. This first narrowed end includes a tab member which is lanced in the flat supporting wall of the first narrowed end which can be turned up into contact with the insulator bracket.

While such an arrangement would effectively locate the insulator bracket in the support wall, when used in an electric clothes dryer heating assembly where the heater coil is mounted in a chord like path, each insulator must be locked in place prior to the insertion of the next insulator.

Accordingly, it would be an advantage to provide a mounting arrangement for an insulator where the insulator is temporarily seated relative to the sidewall prior to locking the insulator in place to permit for all the insulators to be located on the housing wall prior to locking them in place.

SUMMARY OF THE INVENTION

It is an object of the present invention to provide a ceramic insulator and support wall mounting arrangement which allows a heater coil to be mounted relative to the supporting wall.

It is another object of the present invention to provide a heating coil mounting arrangement wherein a ceramic insulator is located in a non-locked position allowing positioning of one or more insulators relative to the supporting wall prior to locking the insulators in place.

In accordance with the present invention there is provided an arrangement for mounting a heater coil relative to a supporting wall. The arrangement comprises a ceramic insulator having a main body portion adapted to secure the heating coil relative thereto. The insulator has a base portion adapted to be seated in fixed relation to the supporting wall. The base portion has first and second flanges. The arrangement further includes a supporting wall that has at least one raised tab member that defines a receiving channel for receiving the first flange of the body portion of the insulator to prevent movement of the first flange outwardly away from the supporting wall. The supporting wall has a pair of spaced apart guide members for locating the second flange therebetween preventing lateral movement of the second flange relative to the supporting wall. In this position, the ceramic insulator and heating coil are mounted in a temporary, non-secured and fixed position. The supporting wall further includes a pivotable movable locking flange positioned adjacent the spaced apart guide members. The movable locking flange has a retracted position that permits insertion of the second flange between the guide members. The movable locking flange may be moved into a locking position for engagement with the second flange to prevent movement of the second flange outwardly away from the supporting wall. In this latter position the locking flange together with the at least one raised tab and the spaced apart guide members effectively locks the insulator in place relative to the sidewall.

BRIEF DESCRIPTION OF THE DRAWINGS

For a better understanding of the nature and objects of the present invention, reference may be had to the accompanying diagrammatic drawings in which.

DETAILED DESCRIPTION OF THE PREFERRED EMBODIMENT

Figure 1:
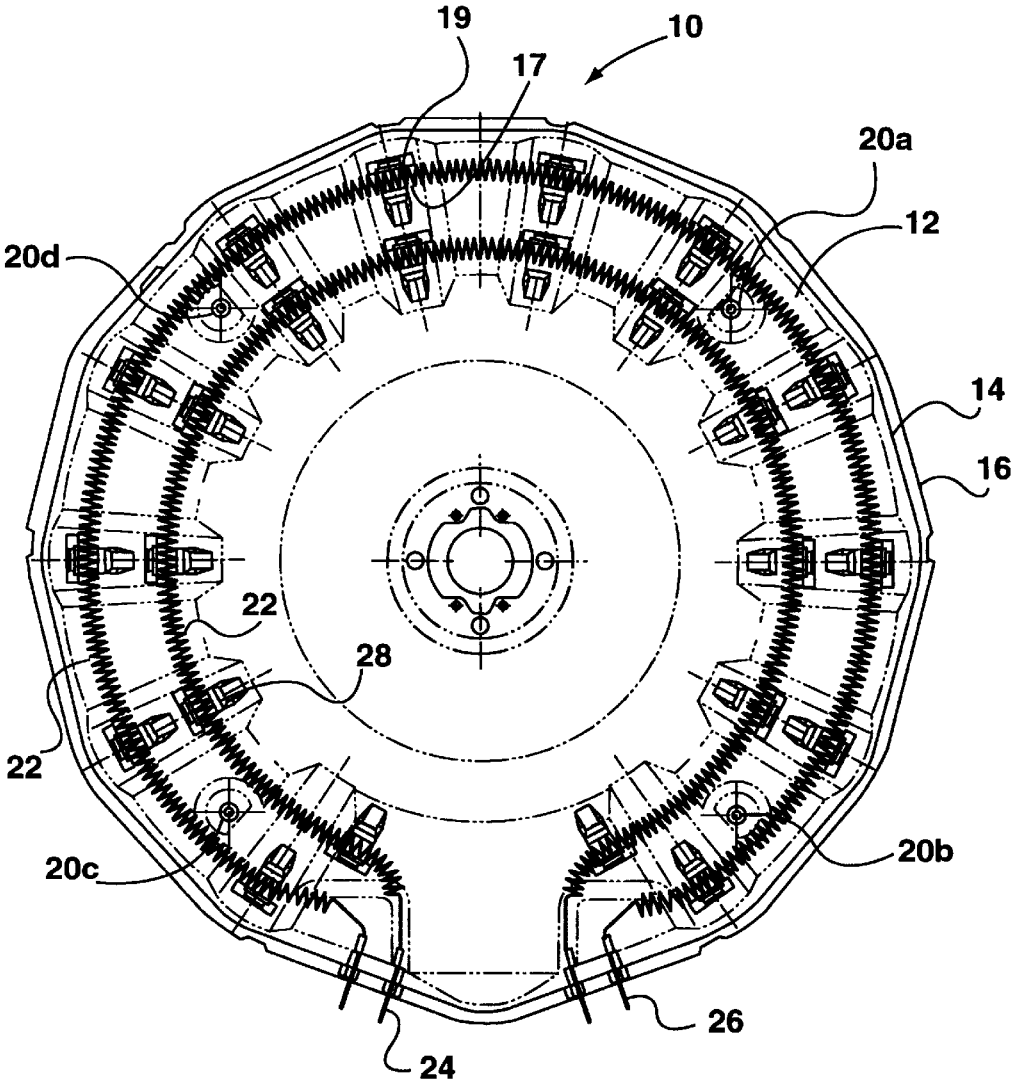
FIG. 1 is an elevation view showing the positioning of heating elements around the perimeter of a dryer support wall and held in place by the heating coil mounting support bracket of the present invention.
Figure 2:
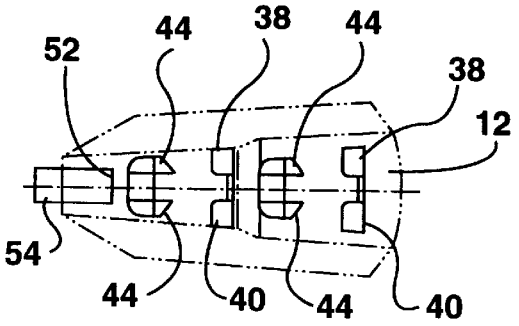
FIGS. 2 and 2*a* are respectively plan and end views of the support wall without the presence of the insulator.
Figure 2A:
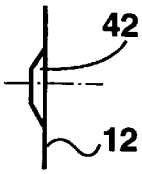

In FIG. 1, a heater assembly 10 suitable for use in a clothes dryer is shown. The heater assembly has a support wall 12 with a peripheral wall 14 and a rim 16 extending around its edges. In the embodiment shown in FIG. 1 four securing bolts 20 *a, b, c* and *d* respectively, are shown for retaining the heater assembly in place relative to the dryer. Two helical wound heater coils 22 extends around the perimeter of support wall 12 in an arcuate manner or chord and define inner 17 and outer 19 radial positions. Heater coils 22 are retained in position by a series of heater coil insulators 28 that are secured to the support wall 12 within the inner 17 and outer 19 radial positions. One end of the heater coils 22 are connected to a power source via terminals 24, and the other ends are connected to terminals 26.

Referring now to FIGS. 1 through 7, the mounting arrangement for the heater coil 22 relative to the supporting wall 12 is shown.

Figure 6:
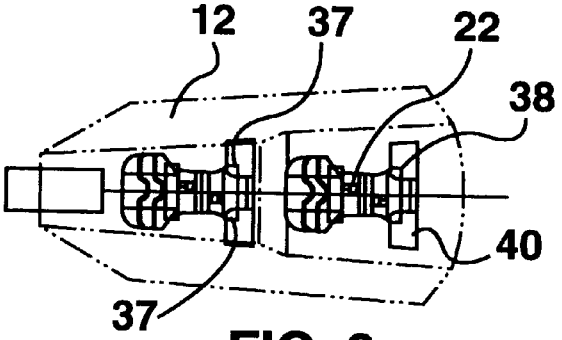
FIGS. 6 and 6*a* are respectively plan and end views of the support wall with the insulator locked in place; and, FIG. 7 is a side view of the support wall with the insulator locked in place.
Figure 6A:
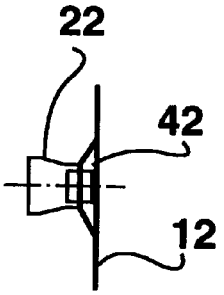
Figure 7:
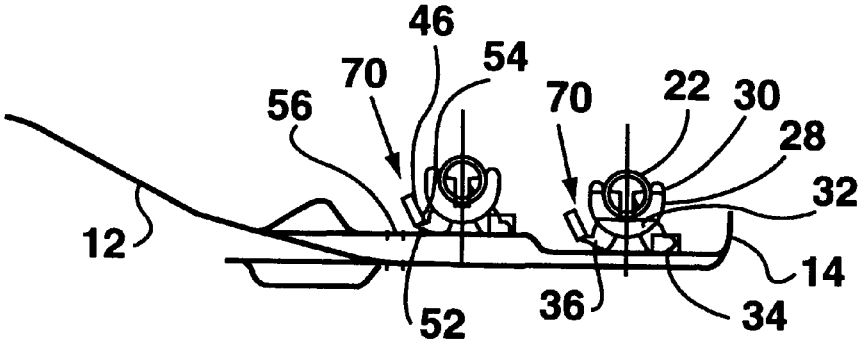

The ceramic insulator 28 (see FIGS. 5 and 7) has a main body portion 30 adapted to secure the heating coil 22 relative thereto. The insulator is a one-piece ceramic insulator 28 that has a base portion 32 adapted to be seated in fixed relation to the supporting wall 12 as shown in FIGS. 6, 6A and 7. For a more complete description of the insulator reference is made to my afore-mentioned U.S. patent application Ser. No. 09/052,121. The base portion 32 of the insulator 28 has two gently curving downwardly and outwardly first and second flanges 34 and 36.

The support wall 12 has a pair of tab members 38 and 40 which define between the tab members 38, 40 and the supporting wall 12 a receiving channel 42 that receives the first flange 34 of the insulator 28 as shown in FIGS. 4 through 7. The receiving channel 42 and the tab members 38, 40 prevent the movement of the first flange 34 away from the supporting wall 12. The tabs 38, 40 cover end portions 37 of flange 34.

The supporting wall 12 further includes a pair of spaced apart guide members 44 which are upstanding tabs. Located between the guide members 44 is the second flange 36 of the insulator 28. The guide members 44 prevent the lateral movement of the second flange 36 relative to the supporting wall 12.

Figure 3:
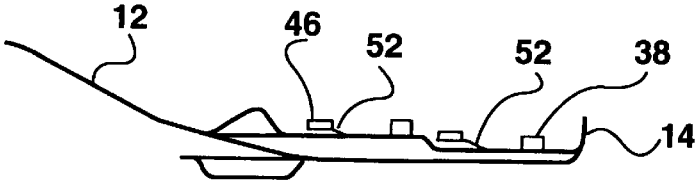
FIG. 3 is a side view of the support wall without the presence of the insulator.

The supporting wall 12 further includes a pivotably movable locking flange 46 that is positioned between these spaced apart guide members 44 and is adapted to pivot along crease 52 (see FIG. 3). The movable locking flange 46 has a retracted position 48 (see FIG. 5) permitting the insertion of the second flange 36 between the guide members 44. The locking flange 46 is movable into a locking position 70 (see FIG. 7) to engage the second flange 36 to prevent the second flange 36 from moving outwardly away from the supporting wall 12. The movable locking flange 46 includes a hooked shaped finger 54 which is adapted to engage an upper surface portion of the second flange 36.

The support wall 12 is further provided with an aperture 56 located below the locking flange 46 so that a finger member 65 (FIG. 5) may be inserted through the aperture 56 to locate or rotate the locking flange 46 into its locking position 70. The insulator 28 is located in a fixed and secured manner against one surface of the supporting wall 12 by the tabs 38 and 40 acting on flange 34 and the locking flange 46 acting on flange 36. Further, lateral movement of the insulator 28 relative to the one surface of supporting wall 12, tabs 38, 40 and locking flange 46 is prevented by tabs or guide members 44 acting on flange 36.

Figure 4:
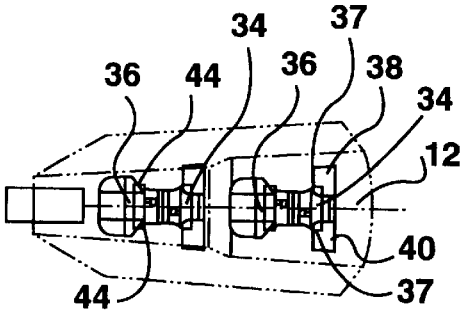
FIGS. 4 and 4*a* are respectively plan and end views of the support wall with the insulator inserted.
Figure 4A:
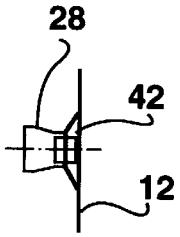
Figure 5:
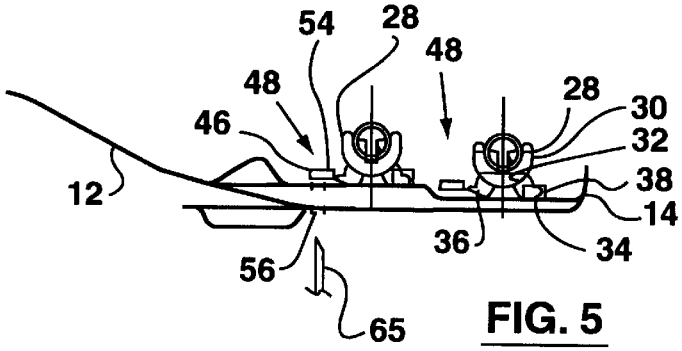
FIG. 5 is a side view of the support wall with the insulator inserted.

In the assembly of the heater coil and insulating brackets relative to the supporting wall 12, the heating coil 22 is placed in a longitudinal manner and inserted onto the insulators 28 at predetermined positions. The insulators 28 are then inserted into the position shown in FIGS. 4, 4A and 5 to form the arcuate shape of the heating coil 22 shown in FIG. 1. In this manner, the arcuate tension on the heating coil 22 tends to pull the insulator's first flange 34 against the tab members 38, 40. Hence the heating coil 22 and the insulators 28 are readily inserted into the positions shown in FIGS. 4, 4A and 5 by human operator and are in a temporary non-locked position. Thereafter, finger like tool 65 is inserted through the apertures 56 in the support wall 12 to move the locking flange 46 into engagement with an upper surface of the second flange 36 of all the insulators 28 thereby locking all the insulators in place.

What I claim is:

1. An arrangement for mounting a heating coil relative to a supporting wall, comprising:

a ceramic insulator having a main body portion adapted to secure the heating coil thereto, the insulator having a base portion adapted to be seated in fixed relation to the supporting wall, and the base portion having first and second flanges; and, the supporting wall having at least one raised tab member defining a receiving channel for receiving the first flange preventing movement of the first flange outwardly away from the supporting wall, a pair of spaced apart guide members for locating the second flange therebetween preventing lateral movement of the second flange relative to the supporting wall, and a pivotably moveable locking flange positioned adjacent the spaced apart guide members, the moveable locking flange having a retracted position permitting insertion of the second flange between the guide members and a locking position engaging the second flange to prevent movement of the second flange outwardly away from the supporting wall.

2. The arrangement for mounting a heating coil relative to a supporting wall of claim 1 wherein each of the first and second flanges of the base portion of the insulator comprise downwardly and outwardly curved flanges extending along the insulator, and two raised tab members each covering an end portions of the first flange.

3. The arrangement for mounting a heating coil relative to a supporting wall of claim 1 wherein the moveable locking flange is pivotably attached to the supporting wall between the guide members and includes a hook shaped finger that engages the top of the second flange when pivoted into the locking position.

4. The arrangement for mounting a heating coil relative to a supporting wall of claim 3 wherein the supporting wall includes a aperture adjacent the locking flange to permit a finger member to pass though the aperture and move the locking flange into the locking position.

5. A heating assembly comprising:

a support wall;

a heater coil;

a plurality of insulators having a body portion to which a portion of the heater coil is mounted and having base portion secured in an arcuate path to the support wall, and the base portion having first and second flanges; and, the supporting wall having at least one raised tab member for each insulator defining a receiving channel for receiving the first flange along a peripheral outside location for the insulator and preventing movement of the first flange outwardly away from the supporting wall, a pair of spaced apart guide members for locating the second flange therebetween preventing lateral movement of the second flange relative to the supporting wall, and a pivotably moveable locking flange positioned adjacent the spaced apart guide members, the moveable locking flange having a retracted position permitting insertion of the second flange between the guide members and a locking position engaging the second flange to prevent movement of the second flange outwardly away from the supporting wall.

6. The arrangement for mounting a heating coil relative to a supporting wall of claim 5 wherein each of the first and second flanges of the base portion of the insulator comprise downwardly and outwardly curved flanges extending along the insulator, and two raised tab members each covering an end portion of the first flange.

7. The arrangement for mounting a heating coil relative to a supporting wall of claim 5 wherein moveable locking flange is pivotably attached to the supporting wall between the guide members and includes a hook shaped finger that engages the top of the second flange when pivoted into the locking position.

8. The arrangement for mounting a heating coil relative to a supporting wall of claim 7 wherein the supporting wall includes a aperture adjacent the locking flange to permit an object to pass though the aperture and move the locking flange into the locking position.

* * * * *